United States Patent [19]

Krause

[11] 4,319,993

[45] Mar. 16, 1982

[54] LARGE-CAPACITY POWER SCREEN

[75] Inventor: Rudolf Krause, Bad Homburg, Fed. Rep. of Germany

[73] Assignee: Rhewum - Rheinische Werkzeug- u. Maschinenfabrik GmbH, Remscheid, Fed. Rep. of Germany

[21] Appl. No.: 216,904

[22] Filed: Dec. 16, 1980

[30] Foreign Application Priority Data

Dec. 20, 1979 [DE] Fed. Rep. of Germany ..... 2951291

[51] Int. Cl.[3] ..... B07B 1/28; B07B 1/30

[52] U.S. Cl. ..... 209/315; 209/366.5; 209/412

[58] Field of Search ..... 209/315, 319, 325, 326, 209/329, 367, 366.5, 404, 405, 408, 409, 412, 415, 403

[56] References Cited

U.S. PATENT DOCUMENTS 2,338,523 1/1944 Lincoln ..... 209/403
3,308,952 3/1967 Parks ..... 209/329
3,834,534 9/1974 Peterson et al. ..... 209/326
4,237,000 12/1980 Read et al. ..... 209/319

FOREIGN PATENT DOCUMENTS 2112577 9/1972 Fed. Rep. of Germany .

*Primary Examiner*—Ralph J. Hill
*Attorney, Agent, or Firm*—Karl F. Ross

[57] ABSTRACT

A screen apparatus has a frame having a pair of spaced-apart longitudinal beams whose ends are bridged by a pair of spaced-apart transverse beams. A central longitudinal member or wall equidistant between the longitudinal beams has ends secured to the transverse beams. Transverse struts extend between the longitudinal beams and through the central wall and support a screen. The frame is mounted for limited displacement relative to a fixed support and a drive motor is fixed to the central member and carries an eccentric for limitedly displacing the frame and the screen in a vibratory or oscillatory manner.

8 Claims, 5 Drawing Figures

LARGE-CAPACITY POWER SCREEN

FIELD OF THE INVENTION

The present invention relates to a screen. More particularly this invention concerns a large-capacity screen of the type driven in a vibratory, oscillatory, reciprocating, or gyratory fashion by a motor mounted directly on the screen frame.

BACKGROUND OF THE INVENTION

A standard type of screen is known having a frame formed by a pair of parallel longitudinal beams whose ends are bridged by transverse beams. A screen is spanned between these longitudinal and transverse beams and the entire assembly lies at a slight inclination to the horizontal, with the transverse beams horizontal and the longitudinal ones tipped. This frame is either supported on springs or elastomeric bodies so that it can move relative to a fixed support or it is hung by flexible links so that such motion is possible. In use material to be screen classified is dumped onto the upper end of the mesh, so that as the material moves down along the mesh the undersize or minus portion will fall through the mesh and the oversize or plus portion will remain on top of it.

The drive for such an apparatus is normally a simple electric motor that is flanged directly to one of the transverse beams and has a horizontal shaft extending parallel to the transverse beams and carrying an eccentric weight. As the shaft is rotated at high speed this weight therefore generates a throw which is transmitted via the transverse beam carrying the motor to the entire frame.

Since all of the energy is transmitted from the motor to the frame via the transverse beam carrying the motor, as described in German patent document 2,112,577 filed Mar. 16, 1971 by the instant inventor with G. Erlenstaedt, this transverse member must be designed to be enormously strong. In fact this transverse beam carrying the drive motor normally accounts for half of the weight of the screen machine. With a screen area of approximately 2 m×6 m the overall weight can be between 5 and 6 tons. Obviously such massive construction increases not only the material costs for making such a screen, but also requires that a very large drive unit be provided in order to impart the necessary motion to the shaker frame whose inertia is very large.

OBJECTS OF THE INVENTION

It is therefore an object of the present invention to provide an improved screen.

Another object is to provide such a screen which would operate as well as the prior-art screens but which can be made substantially lighter.

SUMMARY OF THE INVENTION

These objects are attained according to the instant invention in a screen apparatus of the above-described general type, that is having a frame formed by a pair of spaced-apart longitudinal beams whose ends are bridged by a pair of spaced-apart transverse beams and which has a screen spanning these beams. According to this invention a central longitudinal member is provided between the longitudinal beams and has ends secured to the transverse beams. The drive means includes a drive motor fixed to the central member and an eccentric carried by this member for limitedly displacing the frame and screen relative to a fixed support.

With the system according to the instant invention, therefore, the entire screen frame can be relatively light. Force is transmitted from the motor to the middle wall in an extremely efficient manner, stressing this middle wall neither in bending nor in twisting, but only in compression and extension. Thus the middle wall, which in turn transmits the force to the other elements of the screen, can be made substantially lighter than the transverse beams that normally carry the drive motor. Thus lightening the construction of the screen according to this invention, normally by a factor of between 25% and 30%, also allows the drive motor to be substantially smaller, and the elastic hangers that mount the frame for limited displacement relative to a fixed support also to be substantially smaller and lighter. The result is obviously a considerable saving in construction costs.

According to the instant invention the central member or middle wall is constituted as an upright plate extending in an upright plane parallel to the longitudinal beams of the screen, which normally is elongated longitudinally. According to this invention the frame also comprises transverse parallel struts that extend between and are connected to the longitudinal beams and to the central wall. The screen lies on these struts. According to this invention the struts are of L-section, which of course includes struts of U-section or W-section.

According to this invention the central member can extend vertically above the screen so as to subdivide it into two separate parts. These parts can be of different mesh size if desired.

The drive assembly may be mounted either centrally on top of the middle wall, or at the ends of the middle wall. The motors of the drive assembly may also be provided one above and one below the screen at the ends of the middle wall. No matter what, the drive motor according to this invention is always secured in direct force-transmitting engagement with the middle wall, even when it is bolted through one of the transverse beams to the end of the middle wall.

SPECIFIC DESCRIPTION

Figure 1:
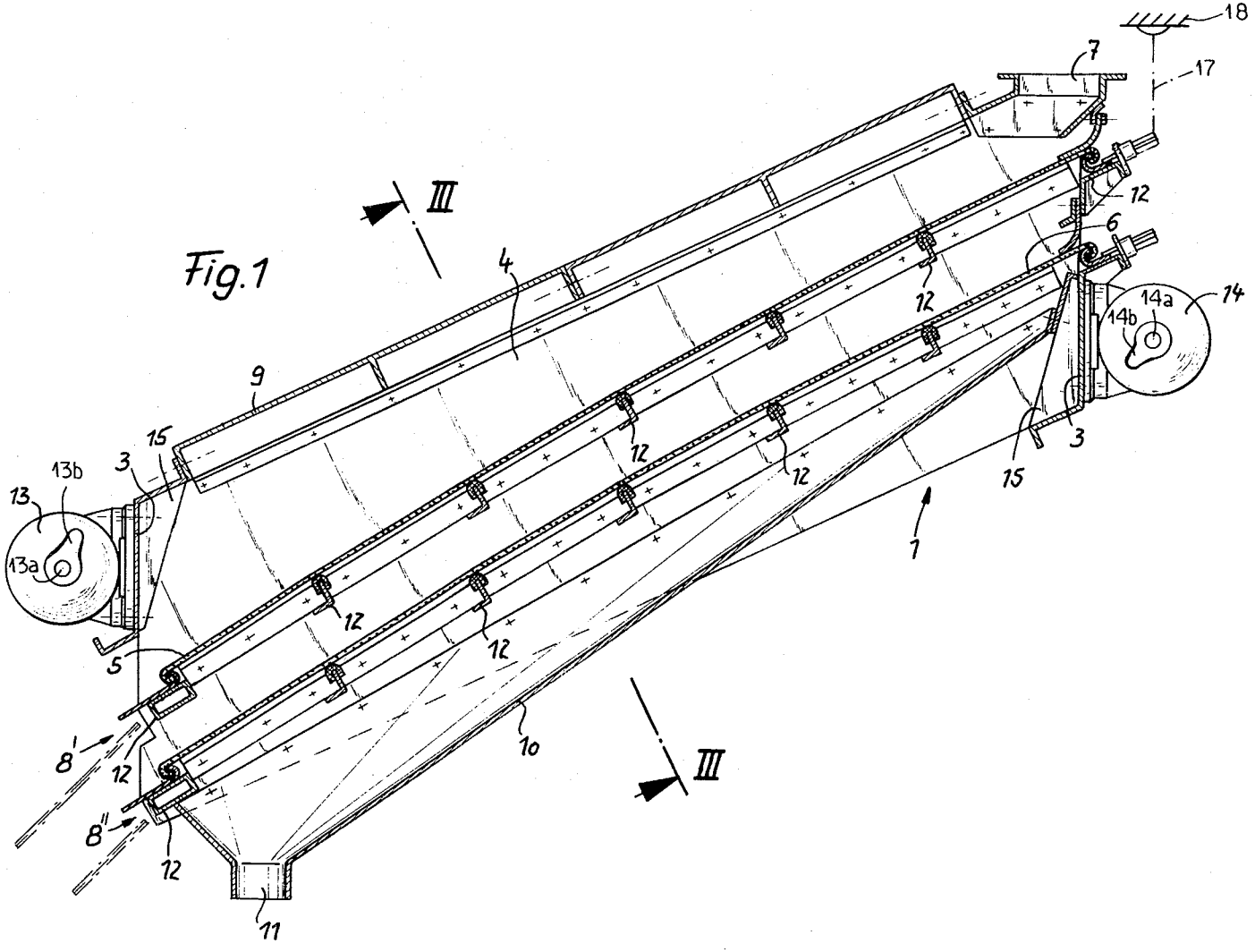
FIG. 1 is a longitudinal section through a screen according to this invention.
Figure 2:
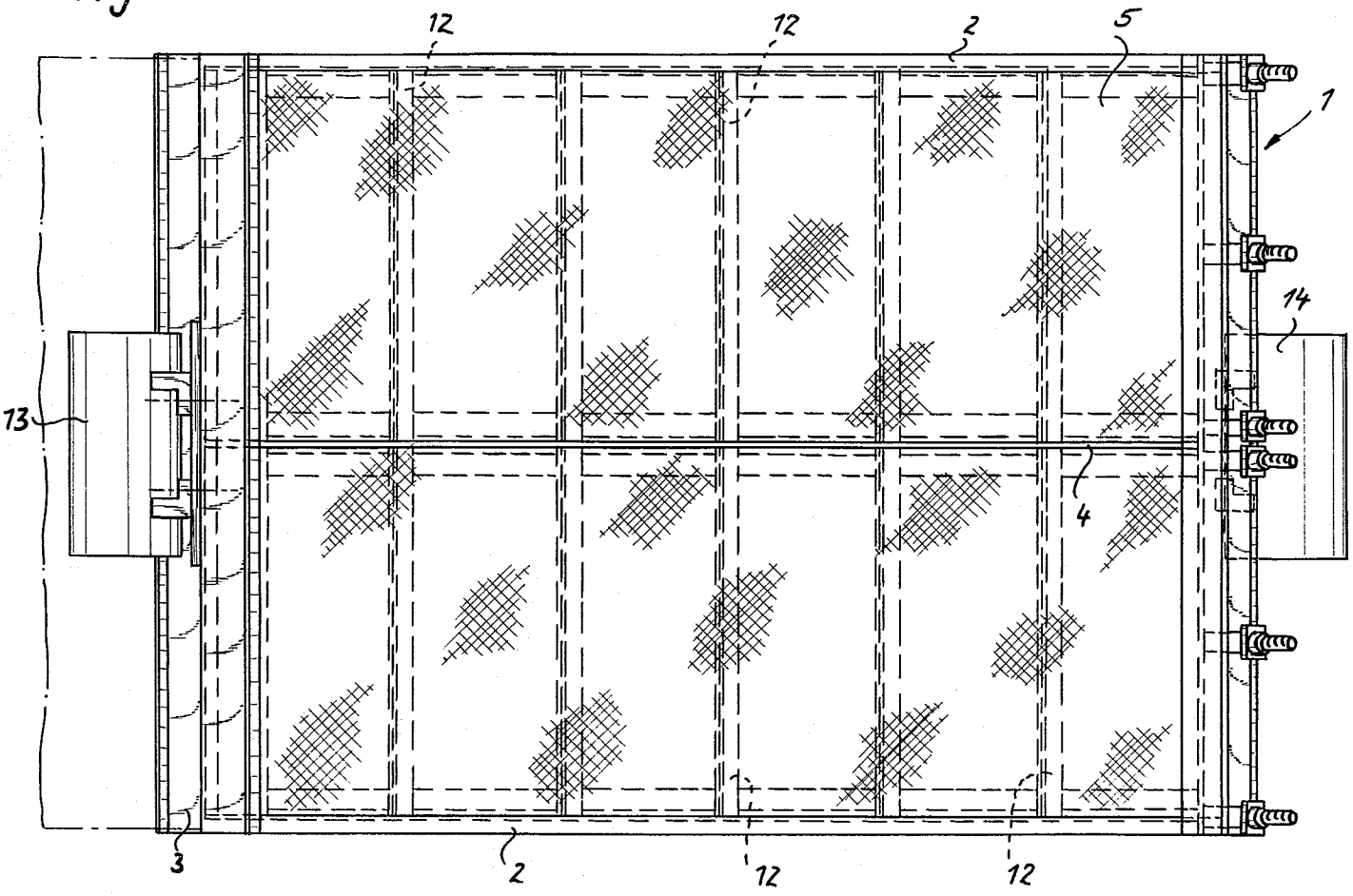
FIG. 2 is a top view of the screen of FIG. 1.
Figure 3:
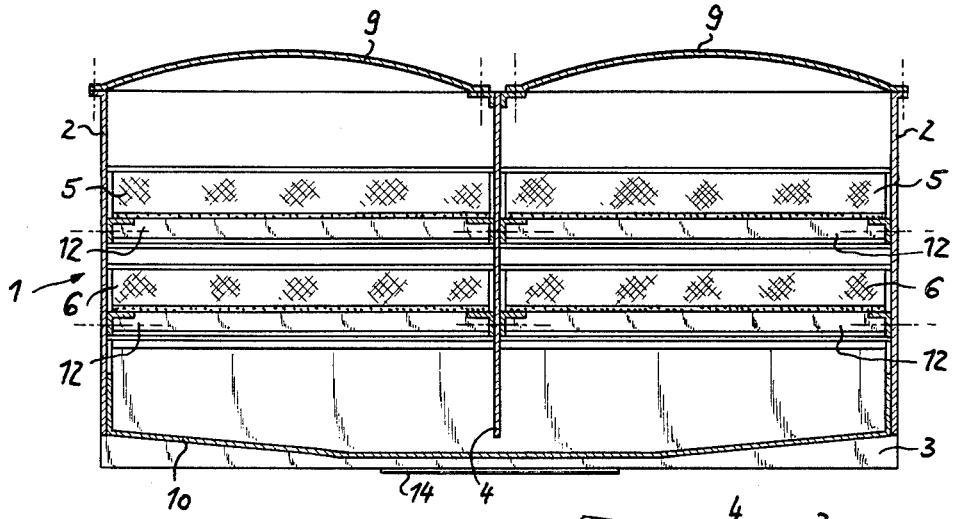
FIG. 3 is a section taken along line III—III of FIG. 1.

As seen in FIGS. 1–3 a screen apparatus according to this invention has a rigid frame 1 suspended by means of mounts shown schematically at 17 from a fixed support 18 for limited displacement relative to this fixed support 18. The screen 1 basically comprises a pair of rigid longitudinally extending side beams 2 constituted as parallel plates lying in respective upright planes. A pair of transverse end beams 3 also constituted as steel plates lying in respective upright planes parallel to each other bridge the ends of the longitudinal side beams 2 so that the frame 1 is basically rectangular. A middle wall or central beam 4 extends parallel to the side walls or longitudinal beams 2 but equidistant therebetween. This middle wall 4 is constituted as best seen in FIG. 3 by a vertical plate lying in a plane equidistant between the planes of the side beams 2. The ends of this middle wall 4 are rigidly secured, normally by welding, to the centers of the transverse end beams 3. A coarse-mesh upper screen 5 and fine-mesh lower screen 6 are spanned between the beams 2 and 3 each subdivided by the middle wall 4 into a pair of parts or panels. In addition five transversely extending angle irons 12 support each of the screens 5 and 6. These angle irons 12 are seated at their ends in the longitudinal side beams 2 and pass through complementarily shaped L-section holes in the middle wall 4.

The two screens 5 and 6 lie as is known per se at an inclination to the horizontal. Frame 1 has at its upstream end an inlet 7 into which ungraded particulate material is fed. At its lower downstream end it has a pair of outlets 8' and 8'' for the oversize portions that flow off the respective screens 5 and 6. A cover 9 is provided on top of the assembly to reduce generation of dust, and a pan 10 with a bottom outlet 11 is provided underneath the lower screen 6 for catching and conducting away the finest portion of the material fed in at the inlet 7.

Bolted through the end beams 3 to the ends of the middle wall 4 are motors 13 and 14 having respective shafts 13*a* and 14*a* carrying respective eccentrics 13*b* and 14*b*. The one motor 13 is mounted above the planes of the screens 5 and 6 on the lower end of the frame 1 and the motor 14 is mounted below these planes on the upper end of the frame 1. Stiffening plates 15 are provided to ensure excellent force transmission between the motors 13 and 14 and the central wall 4.

With the system according to the instant invention, therefore, the principal motor force will be transmitted to the central wall 4 and therethrough to the screens 5 and 6.

Figure 4:
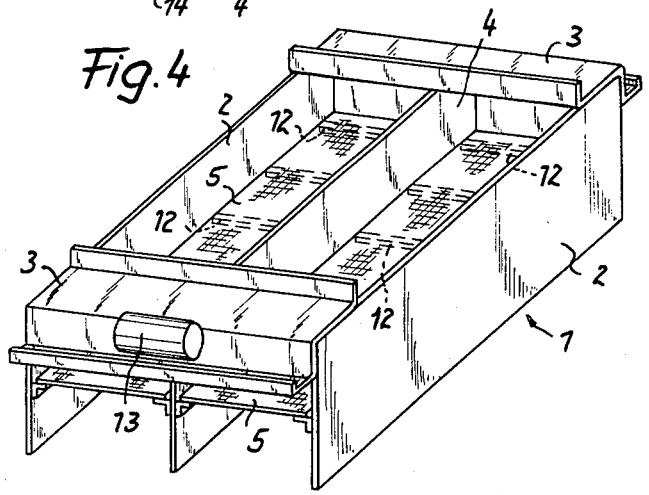
FIGS. 4 and 5 are small-scale perspective views showing two further screens according to this invention.
Figure 5:
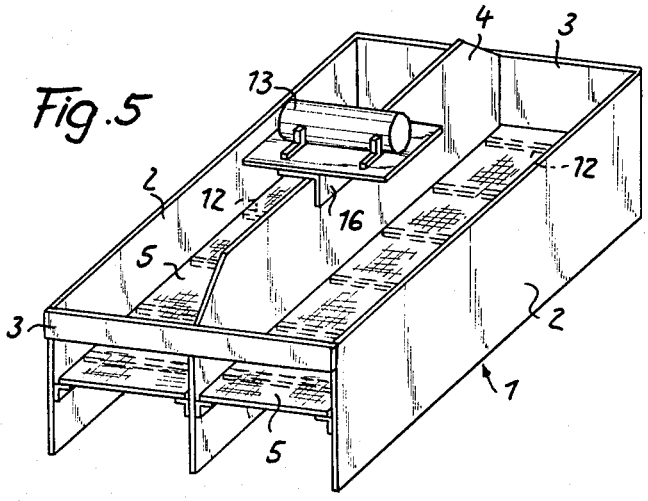

FIG. 4 shows an arrangement wherein only a single such drive unit 13 is provided. In FIG. 5 a single such drive unit 13 is provided, but it is mounted on a platform 16 secured to the longitudinal middle of the central wall 4. Two such motors 13 could be mounted on this platform 16, and further motors 13 and 14 could be mounted at the ends as shown in FIG.1 also if desired. The frequency and amplitude of the different drive motors can be variable to create a compound movement of the frame 1.

According to this invention the central wall 4 is between one quarter and one half, normally one-third, thicker than the side walls 2. This central wall 4 is, however, only under compression and tension so that it is capable of transmitting considerable forces.

I claim:

1. A screen apparatus comprising:

a generally planar frame inclined at an acute angle to the horizontal and having a pair of spaced-apart longitudinal beams, a pair of spaced-apart transverse beams bridging the ends of said longitudinal beams, and a central longitudinal member between said longitudinal beams and having high and low ends secured to said transverse beams;

a generally planar screen inclined at an acute angle to the horizontal and spanning said beams;

means for mounting said frame for limited displacement relative to a fixed support; and drive means including a pair of drive motors fixed to said central member and respective eccentrics carried by said motors for limitedly displacing said frame and screen relative to said support, one of said motors being mounted on said high end below the plane of said screen and the other of said motors being mounted on said low end above the plane of said screen.

2. The apparatus defined in claim 1 wherein said longitudinal beams are plates lying in respective upright planes.

3. The apparatus defined in claim 1 wherein said central member is a flat plate lying in an upright plane.

4. The apparatus defined in claim 1 wherein said frame further comprises transverse stiffening struts extending between and connected to said longitudinal beams and member, said screen lying on said struts.

5. The apparatus defined in claim 4 wherein said struts are L-section.

6. The apparatus defined in claim 1 wherein said central member is a flat plate lying in an upright plane bisecting the plane of said screen and subdividing same into two parts.

7. The apparatus defined in claim 1 wherein said eccentrics are each rotatable about a respective horizontal axis perpendicular to said longitudinal beams and member.

8. The apparatus defined in claim 1 wherein one of said motors is mounted at one end of said central member and the other of said motors is mounted at the other end of said central member.

* * * * *